US005823615A

United States Patent [19]

Haut

[11] Patent Number: 5,823,615

[45] Date of Patent: Oct. 20, 1998

[54] TRAY FOR A HIGH CHAIR

[75] Inventor: Robert E. Haut, Paoli, Pa.

[73] Assignee: Graco Children's Products Inc., Eleverson, Pa.

[21] Appl. No.: 694,476

[22] Filed: Aug. 7, 1996

[51] Int. Cl.[6] ..... A47B 83/02

[52] U.S. Cl. ..... 297/151; 297/153

[58] Field of Search ..... 297/149, 151, 297/153; 108/155, 157

[56] References Cited

U.S. PATENT DOCUMENTS

| | | | |
|---|---|---|---|
| D. 131,679 | 3/1942 | Greenbaum . | |
| D. 152,383 | 1/1949 | Waaranan | D15/8 |
| D. 344,189 | 2/1994 | Golenz et al. | D6/339 |
| 1,178,894 | 4/1916 | Wilcox . | |
| 1,428,916 | 9/1922 | Snideman . | |
| 2,131,722 | 10/1938 | Arthur | 155/127 |
| 3,383,134 | 5/1968 | Webb et al. | 297/153 |
| 3,475,052 | 10/1969 | Kaposi | 297/153 |
| 3,516,709 | 6/1970 | Nader | 297/153 |
| 4,105,247 | 8/1978 | Saint | 297/149 |
| 4,512,607 | 4/1985 | Rapp | 297/153 |
| 4,650,246 | 3/1987 | Henriksson | 297/250 |
| 4,807,928 | 2/1989 | Cone | 297/151 |
| 4,818,016 | 4/1989 | Mariol et al. | 297/174 |
| 4,819,988 | 4/1989 | Hellstrom | 297/467 |
| 4,842,331 | 6/1989 | Waples | 297/149 |
| 4,844,537 | 7/1989 | Reed | 297/174 |
| 4,968,092 | 11/1990 | Giambrone | 297/151 |
| 5,106,156 | 4/1992 | Marquis | 297/153 |
| 5,118,161 | 6/1992 | Slowe et al. | 297/153 |
| 5,131,715 | 7/1992 | Balles | 297/5 |
| 5,165,755 | 11/1992 | Rho | 297/345 |
| 5,183,311 | 2/1993 | Meeker et al. | 297/151 |
| 5,238,292 | 8/1993 | Golenz et al. | 297/153 |
| 5,334,099 | 8/1994 | Marra et al. | 472/118 |
| 5,364,137 | 11/1994 | Shimer | 297/327 |
| 5,458,394 | 10/1995 | Nichols et al. | 297/173 |
| 5,468,043 | 11/1995 | Chien | 297/153 |
| 5,489,138 | 2/1996 | Mariol et al. | 297/153 |
| 5,507,550 | 4/1996 | Maloney | 297/153 |
| 5,509,719 | 4/1996 | Cone, II | 297/344.14 |
| 5,527,090 | 6/1996 | Cone, II | 297/149 |
| 5,527,096 | 6/1996 | Shimer | 297/327 |

OTHER PUBLICATIONS

Best Catalog, 1994/1995, p. 477.

*Primary Examiner*—Peter M. Cuomo
*Assistant Examiner*—Gerard A. Anderson
*Attorney, Agent, or Firm*—Richard B. O'Planick

[57] ABSTRACT

An improved removable tray for use with a juvenile product is disclosed. A pair of side handles are provided on the bottom of a tray portion and are interconnected by a flexible interconnection member. The flexible interconnection member ensures that the operation of one of the side handles will create an equivalent operation in the other. Thus, one-handed operation of the preferred tray is possible. A center button may also be provided to allow the tray to be removed. A spring connected to the flexible interconnection member provides an appropriate bias to lock the tray in place. Accordingly, the present invention provides a simple, yet elegant and reliable solution to the problems in conventional trays.

20 Claims, 8 Drawing Sheets

TRAY FOR A HIGH CHAIR

BACKGROUND OF THE INVENTION

1. Field of the Invention

The present invention relates to a removable tray which is adapted for use in a juvenile product, and in particular to an easy-to-use removable tray for a high chair.

2. Description of the Related Art

Conventional high chair trays are often removable from the high chair to allow easy loading or unloading of a child from the chair. Typically, high tray chairs include a mechanism located on both sides of the tray to allow it to be affixed to the chair. Many of the conventional trays are difficult to use.

A pair of side handles are provided to connect to the high chair on some conventional trays. The user may grasp the tray at its sides and activate the side handles to remove or install the tray. The operation of one side handle may activate the other side handle to allow the tray to be removed with one hand and some mechanical linkage between the side handles is necessary to facilitate this operation.

Conventional mechanical linkages between side handles suffer from many problems. Often, they are inconvenient and consist of many parts involving a complicated mechanical configuration. Furthermore, such mechanical linkages are often unreliable and must be covered up to reduce the risk of finger pinching by the operator or the child. Furthermore, conventional linkage mechanisms are expensive and difficult to manufacture.

SUMMARY OF THE INVENTION

Accordingly, the present invention is directed to a high chair tray that substantially obviates one or more of the problems due to limitations and disadvantages of the related art.

The present invention has been made in view of the above circumstances and has as an object to provide a tray of simple design with few moving parts.

A further object of the present invention is to provide a tray which is easy to operate and provides the user with several options for one-handed operation.

A still further object of the present invention is to provide a tray which is easy to manufacture and which may be quickly assembled with minimal effort.

Yet another object of the present invention is to provide a tray which provides a reliable linkage between side handles.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention is directed to a tray adapted for connection to a juvenile product comprising a tray portion, a first connection member and a second connection member disposed adjacent to a bottom surface of the tray portion for connecting the tray to the juvenile product, each connection member being operable between an open and a closed position, and a flexible interconnection member disposed adjacent to the bottom surface of the tray portion and connected to the first and second connection members so that an operation of the first connection member causes a corresponding operation in the second connection member.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles on of the invention. In the drawings.

DETAILED DESCRIPTION OF THE PREFERRED EMBODIMENT

Reference will now be made in detail to the present preferred embodiments of the invention, examples of which are illustrated in the accompanying drawings. Wherever possible, the same reference numbers will be used throughout the drawings to refer to the same or like parts.

Figure 1:
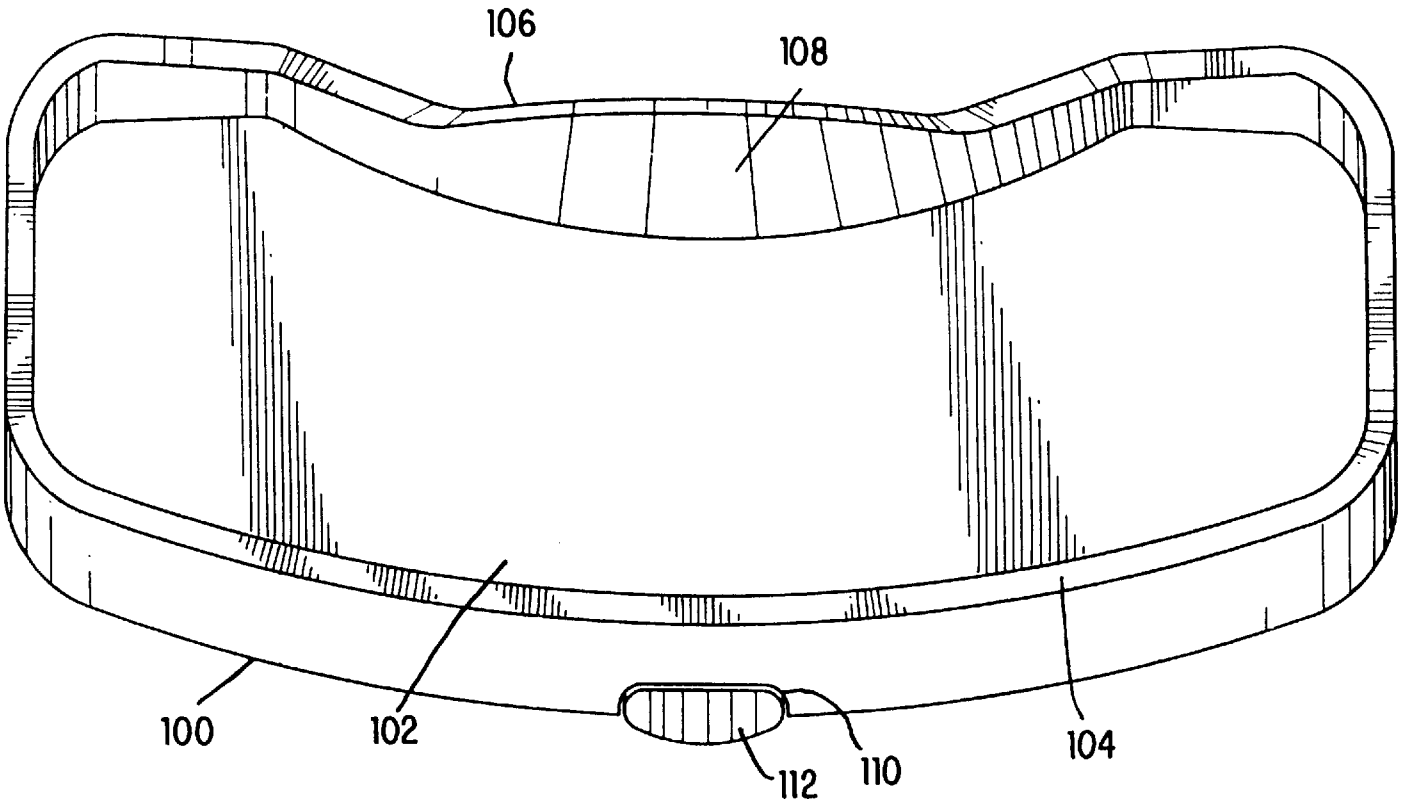
FIG. 1 is a perspective view of a preferred tray according to the present invention.

The present invention is directed to a tray adapted for connection to a juvenile product, such as a high chair. As embodied herein, a tray portion 100 is provided, and includes a flat surface 102 surrounded by a raised edge 104. The raised edge 104 preferably serves to prevent items, such as food or drink, from spilling or falling off of the flat surface 102. The tray portion 100 also includes an indented section 106, as shown in FIG. 1. The indented section 106 is intended to allow room for the child to sit in the juvenile product (not shown). As shown in FIG. 1, the indented section 106 includes a spill catching lip 108 which extends upward from the top surface of the adjacent raised edge 104 and which slopes towards the center of the flat surface 102. As will be appreciated, the spill catching lip 108 can direct spilled food or drink onto the tray portion 100 and prevent it from reaching the floor or the child.

Located at the front side of the tray portion 100 is a notch 110 as shown in FIG. 1. The notch 110 allows for the placement of a button 112 which, as explained in more detail hereafter, allows for the easy removable of the tray portion 100 from the juvenile product (not shown). The preferred embodiment includes the button 112 which is connected to an interconnection member (not shown in FIG. 1) to activate an attachment mechanism disposed underneath the tray portion 100.

Figure 2:
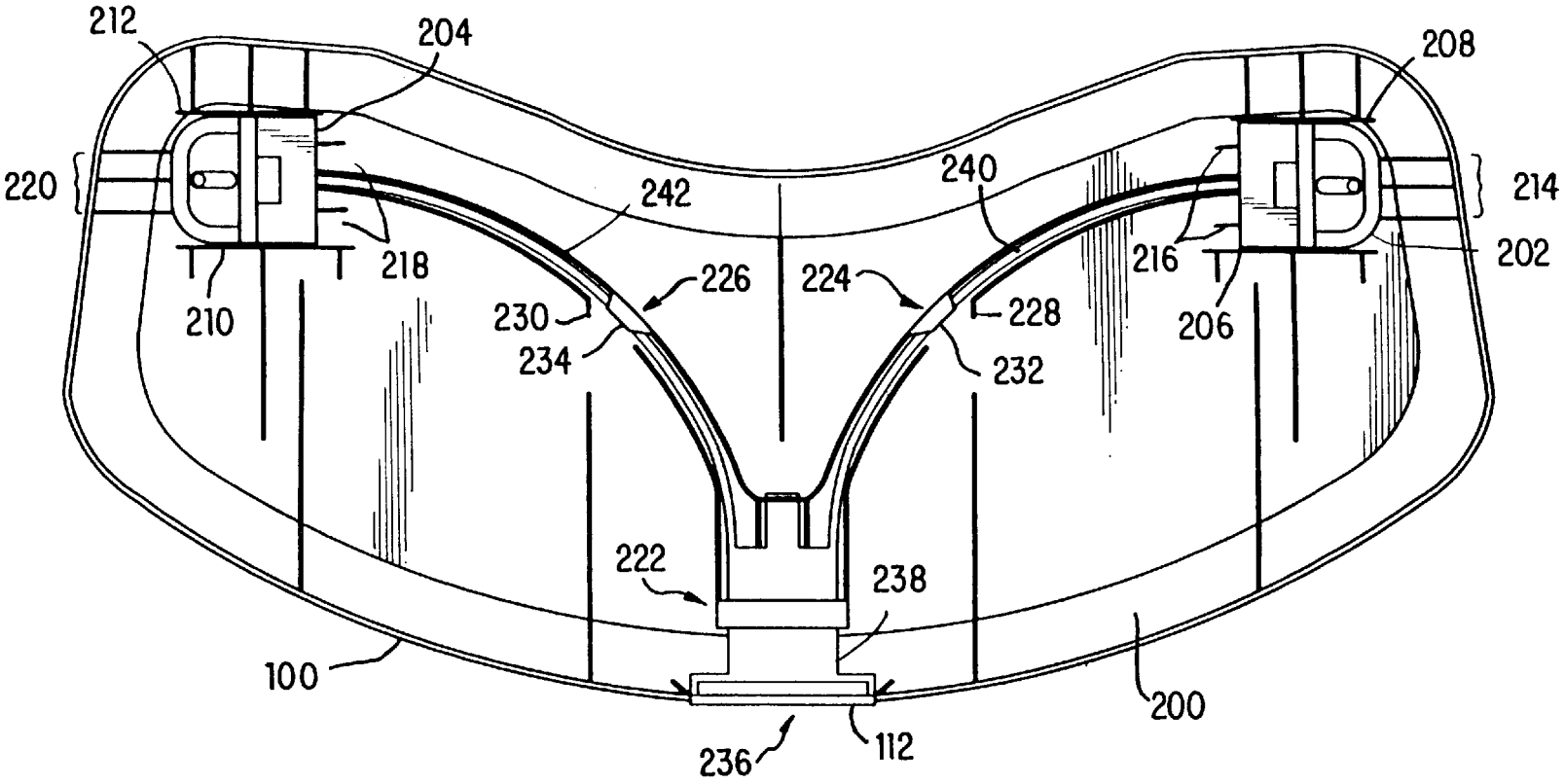
FIG. 2 is a bottom view of a preferred tray according to the present invention.

FIG. 2 shows a bottom view of the tray portion 100 along with several other preferred components of the present invention installed thereon. Initially, it should be noted that most of the preferred components of the present invention are formed of a molded plastic material such as styrene or polypropylene. As will be appreciated, the construction of the preferred parts described herein is designed to facilitate the manufacturing of these parts, preferably by an injection molding process.

The tray portion 100 includes at its outer periphery a channel 200 which surrounds a central portion of the tray portion 100 and corresponds to the raised edge 104 shown in FIG. 1. Right and left connection members 202, 204 are disposed adjacent to the bottom surface of the tray portion 100 and are preferably used to connect the tray portion 100 to the juvenile product. As explained hereafter, each of the connection members 202, 204 is operable between an opened and a closed position. As embodied in FIG. 2, the connection members 202, 204 are slidable between the open and closed positions.

In accordance with the invention, the preferred embodiment includes a first pair of guide extensions 206, 208 and a second pair of guide extensions 210, 212 which facilitate the sliding of the connection members 202, 204, respectively. Preferably, each pair of guide extensions includes two upstanding vertical extensions from the bottom surface of the tray portion 100, disposed an appropriate distance apart to allow the connection member to fit therebetween. Guide extensions 206, 208 are parallel to each other and allow for a smooth sliding action of connection member 202. Guide extensions 210, 212 perform a similar function for connection member 204.

In accordance with the invention, the preferred embodiment includes three outer rails 214 extending from beneath connection member 202 on its right side in FIG. 2, and a pair of inner rails 216 extending from beneath the connection member 202 on its left side. Similarly, three outer rails 220 extend from underneath the connection member 204 on its left side, and a pair of inner rails 218 extends from beneath the connection member 204 on its right side. Preferably, the inner and outer rails are formed of an upstanding vertical extension from the bottom surface of the tray portion 100. The inner and outer rails 214–220 cooperate with appropriate structure underneath the connection members 202 and 204 to ensure consistent and accurate sliding action between the opened and closed positions.

In accordance with the invention, the preferred embodiment includes a housing which extends from the bottom surface of the tray portion 100 for receiving a flexible interconnection member. As embodied herein, FIG. 2 shows a housing, generally referred to as 222, disposed in a lower central portion of the tray portion 100. The structural details of the housing 222 are discussed hereinafter with respect to FIG. 9.

In accordance with the invention, the preferred embodiment further includes a pair of guide slots extending from the bottom surface of the tray portion 100 and generally curving from the housing 222 to each of the connection members 202, 204. As embodied herein, FIG. 2 shows a right guide slot 224 and a left guide slot 226, which generally comprise an inner and outer extension to form a U-shaped channel. Most preferably, each guide slot 224 and 226 includes an angular tab 228 and 230, respectively, and a track stay 232 and 234, respectively, as shown in FIG. 2.

In accordance with the invention, the preferred embodiment further includes a flexible interconnection member. As embodied herein, FIG. 2 shows a preferred flexible interconnection member 236, which includes the button 112 adjacent to a rigid portion 238, which rigid portion 238 is adjacent to a pair of flexible connection straps 240 and 242. The connection straps 240 and 242 are preferably disposed within the right and left guide slots 224 and 226, respectively, as shown in FIG. 2. The operation and cooperation of the flexible interconnection member and the connection members 202, 204 is explained in more detail with reference to FIGS. 7–10.

Figure 3:
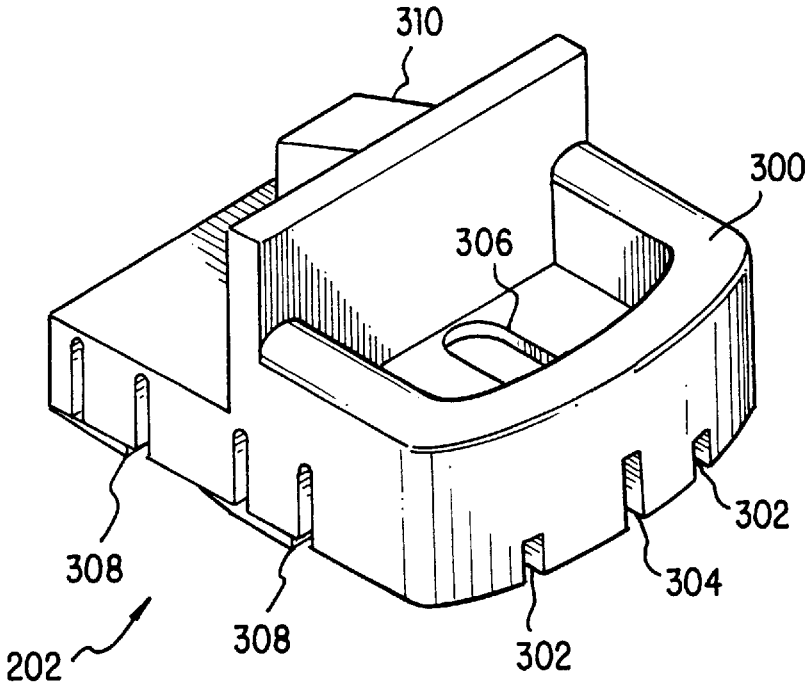
FIG. 3 is a perspective view of a preferred connection member according to the present invention.

FIG. 3 shows a preferred implementation of a connection member 202. In particular, the connection member 202 comprises a hand receiving portion 300 adapted to be grasped by the user. The lower surface of the connection member 202 includes two slots 302 adapted to receive the two inner rails 216 shown in FIG. 2 to ensure smooth sliding of the connection member 202. A somewhat larger slot 304 is shown disposed between slots 302. Larger slot 304 is intended to receive the end portion of the flexible interconnection member 236.

In the center of the hand receiving portion 300 is an elongated hole 306 which is adapted to receive an extension (not shown) from the bottom of the tray portion 100. In the most preferred embodiment, a screw may be inserted through the elongated hole 306 and into the extension (not shown) in the bottom of the tray portion to secure the connection member 202 to the tray portion 100. It should be understood that the use of a screw is optional in the most preferred embodiment.

On the side of the connection member 202 is disposed two locking tabs 308 which are adapted to cooperate with the right and left guide extensions to secure the connection member 202 to the bottom of the tray portion 100. The insertion of the connection member 202 into the guide extensions 206, 208 is described in more detail with regard to FIG. 7.

A connection portion adapted to engage with the juvenile product to connect the tray portion 100 to the juvenile product is shown in FIG. 3. In particular, the connection portion 310 is an extension of the connection member 202 which may be preferably shaped to cooperate with appropriate structure in the juvenile product to secure the tray to the product. Most preferably, the sliding action of the connection member 202 between the opened and closed position will release and engage the appropriate structure in the juvenile product (not shown)

Figure 4:
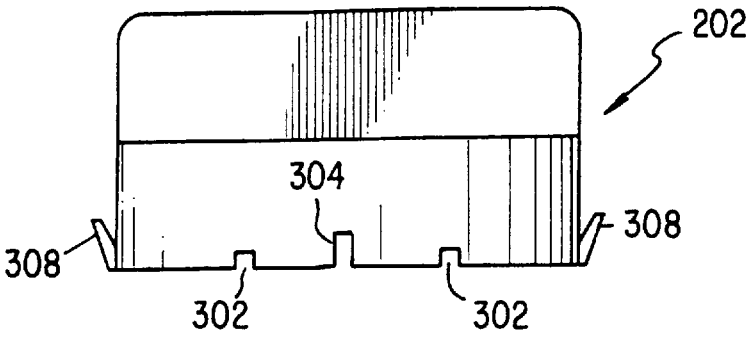
FIG. 4 is an end view of a preferred connection member according to the present invention.

FIG. 4 shows an end view of the connection member 202. In particular, the locking tabs 308 are more clearly shown with a sloping outward extension. Further, the preferred width and height of the slots 302 and the larger slot 304 is shown.

Figure 5:
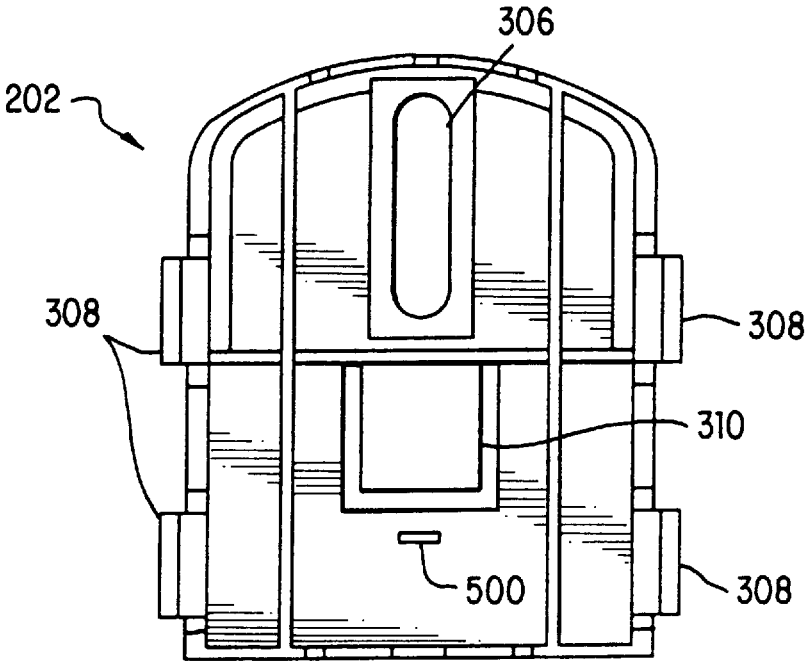
FIG. 5 is a bottom view of a preferred connection member according to the present invention.

FIG. 5 shows a bottom view of the connection member 202. In particular, the generally rectangular bottom view of the connection portion 310 is shown. Of course, it should be understood that the shape and structural features of the connection portion 310 can be altered to appropriately match the receiving structure provided on the juvenile product (not shown). Furthermore, FIG. 5 shows the stop tab 500 disposed below the connection portion 310. Preferably, the stop tab 500 is a rectangular extension extending at a right angle from the bottom surface of the connection member 202. As explained in more detail with regard to FIG. 6, the stop tab 500 limits the amount of sliding action in the preferred connection member 202 with respect to the tray portion 100.

Figure 6:
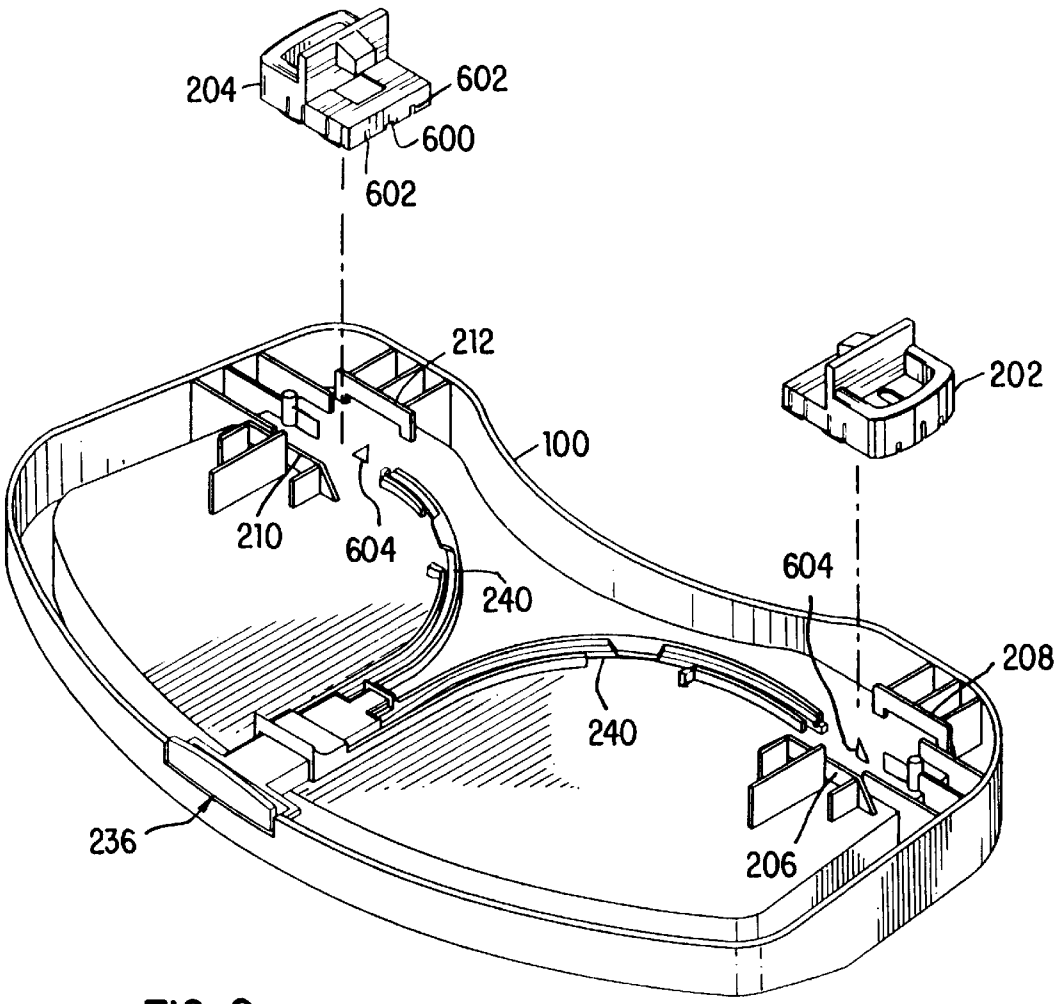
FIG. 6 is an exploded view showing the insertion of the preferred connection members into the tray portion of the present invention.
Figure 9:
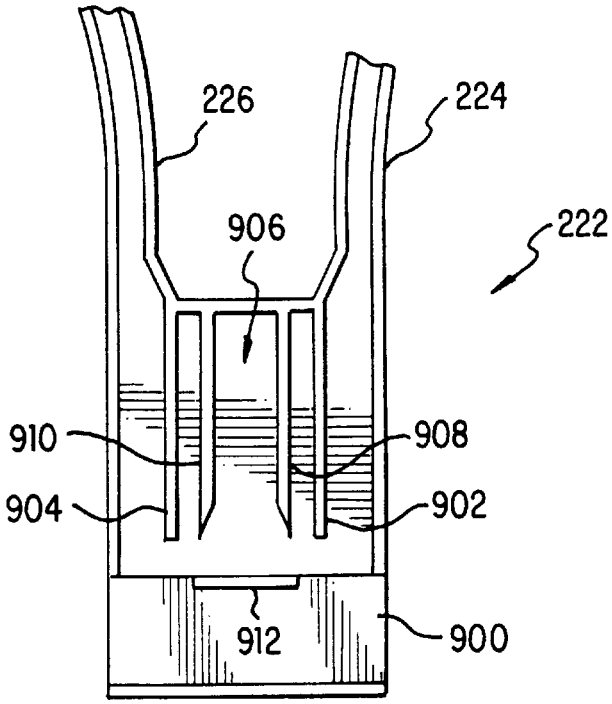
FIG. 9 is a top view of a preferred housing of the present invention.

FIG. 6 shows in exploded form the connection members 202, 204 spaced above the tray portion 100. The flexible interconnection member 236 is shown in its inserted position. During assembly, the connection members 202, 204 are lowered onto the tray portion as indicated in FIG. 9, until the locking tabs 308 contact the right and left guide extensions 206–212. The connection members 202, 204 are then depressed further to cause the locking tabs 308 to flex inwardly and allow further downward movement. Once the locking tabs 308 reach the opening at the lower end of the guide extensions 206, 208, the locking tabs 308 snap back into place, thereby holding the connection member 202 in place. Of course, the slots 302 and 304 in the lower surface of connection member 202 must match and cooperate with the appropriate inner and outer rails 214, 216.

Figure 7:
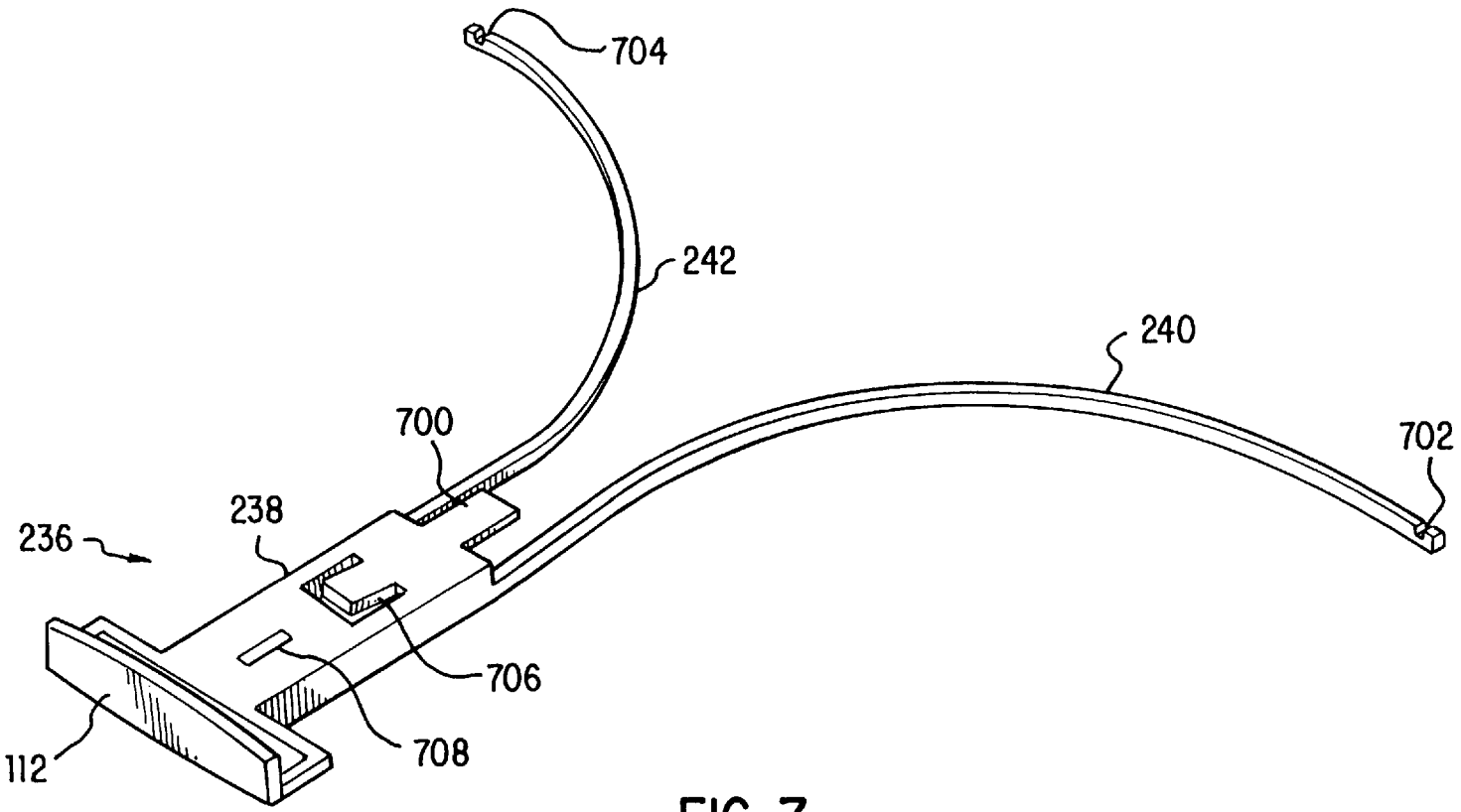
FIG. 7 is a perspective view of a preferred flexible interconnection member of the present invention.

FIG. 6 shows the connection member 204 having a receiving slot 600 corresponding to a notch in the end of the flexible strap 240 (described with respect to FIG. 7). Connection member 204 is further shown with slots 602 designed to cooperate with inner rails 218 (shown in FIG. 2) to ensure stable and smooth sliding action of the connection member 204. Connection member 202 includes similar structure (not shown).

FIG. 6 also shows a pair of stop extensions 604 which are intended to cooperate with the connection members 202, 204 to limit the range of sliding. Preferably, stop extensions 604 are upstanding triangular-shaped extensions from the bottom of the tray portion 100, as shown in FIG. 6. During operation, the stop tab 500 of connection member 202 is adapted to abut the vertical portion of stop tab 604 as the connection member 202 slides to the right, as shown in FIG. 6. Similarly, the stop tab 500 of the connection member 204 cooperates with the stop extension 604 to limit the sliding action of the connection member 204 to the left, as shown in FIG. 6.

FIG. 7 shows a preferred flexible interconnection member 236, as previously described. In particular, FIG. 7 shows a guide tab 700 extending from the rigid portion 238. As explained in more detail with reference to FIG. 10, the guide tab 700 cooperates with the housing 222 to ensure proper sliding action of the flexible interconnection member 236. Further, FIG. 7 shows a notch 702 at the end of the right flexible connection strap 240 and a notch 704 at the end of the left flexible connection strap 242. The notches 702, 704 are designed to cooperate with the receiving slots 600 of the connection members 202, 204, respectively.

A locking tab 706 is further shown in FIG. 7, and is adapted to extend slightly upwardly from the top surface of the rigid portion 238. As explained in more detail with regard to FIG. 10, the locking tab 706 cooperates with a portion of the housing 222 to lock the flexible interconnection member 236 into place after insertion. FIG. 7 further shows a rectangular orifice 708 directly above a spring holding post (not shown in FIG. 7) to facilitate the molding operation of the preferred flexible interconnection member 236.

Figure 8:
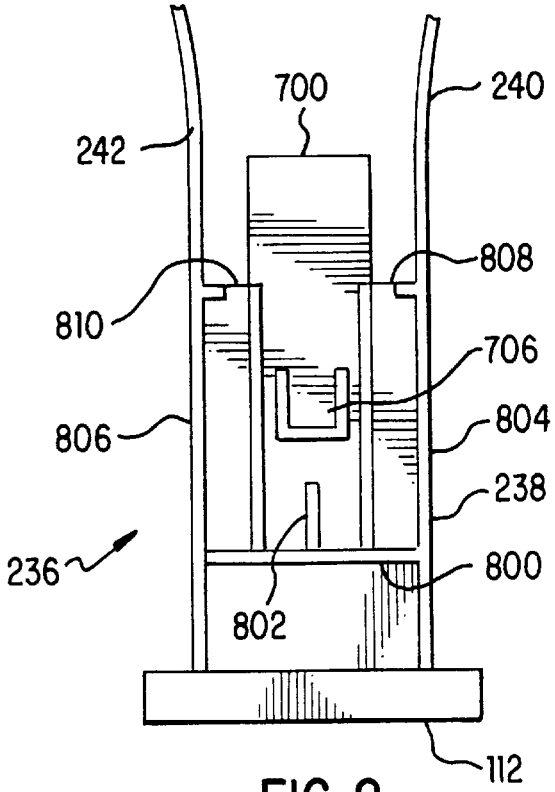
FIG. 8 is a bottom view of a preferred flexible interconnection member of the present invention.

FIG. 8 shows a bottom view of the flexible interconnection member 236. In particular, FIG. 8 shows an end wall 800 connected between a first side wall 804 and a second side wall 806. A spring holding post 802 extends horizontally from the end wall 800, and is disposed directly over the orifice 708, shown in FIG. 7. The spring holding post is a generally rectangular extension adapted to receive a circular spring thereon. In the most preferred spring holding post 802, the distal end is slightly tapered to facilitate the insertion of the spring thereon. FIG. 8 further shows two orifices 808 and 810 adjacent to the side walls 804 and 806, respectively, which are adapted to receive a rail in the housing 222 to ensure proper sliding action of the flexible interconnection member 236.

FIG. 9 shows a top view of the housing 222 in more detail. In particular, FIG. 9 shows a top portion 900 which forms an orifice (not shown in FIG. 9) for receiving the flexible interconnection member 236. A first and second housing rail 902 and 904 are provided in the housing 222 and are adapted to cooperate with the orifices 808 and 810 in the flexible interconnection member 236. The housing rails 902 and 904 are adapted to slide within the orifices 808 and 810 to ensure smooth operation of the flexible interconnection member 236.

The housing 222 further includes a spring channel 906 formed by a first and second side member 908 and 910. Preferably, the ends of the side members 908 and 910 are tapered to facilitate insertion of the spring (not shown). Finally, a catch 912 is provided on the top portion 900 and extends vertically therefrom. The catch 912 is intended to cooperate with the locking tab 706 of the flexible interconnection member 236 as explained in more detail with regard to FIG. 10.

Figure 10:
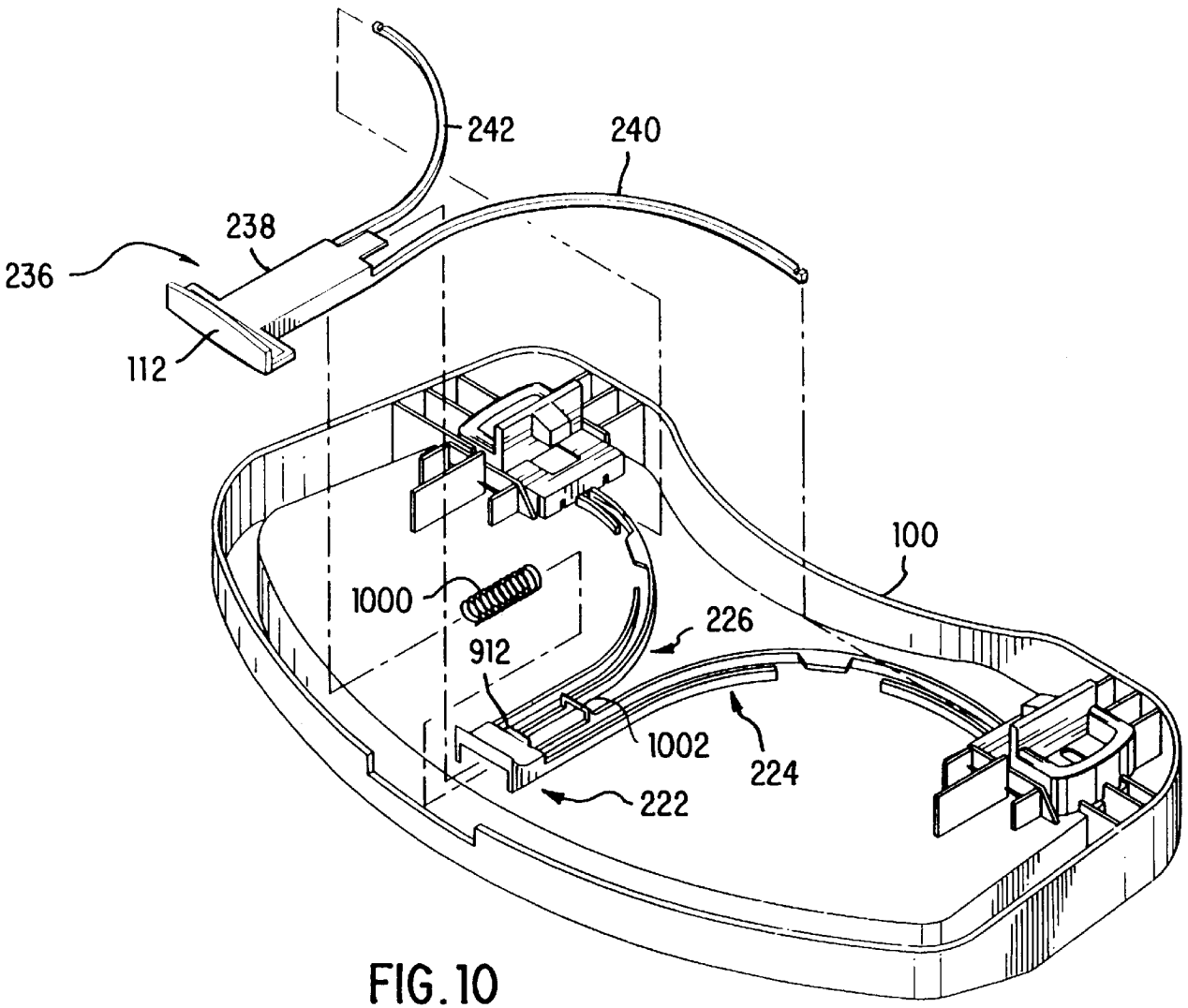
FIG. 10 is an exploded view of the arrangement of a preferred flexible interconnection member into the housing of a preferred tray according to the present invention.

FIG. 10 shows, in exploded form, the flexible interconnection member 236 and its insertion location on the tray portion 100. As shown in FIG. 10, the ends of the flexible straps 240, 242 are inserted into the orifice of the housing and pushed along the right and left guide slots 224, 226, respectively, until partially inserted. Then, spring 1000 is inserted into the spring channel 906 of the housing 222 until it abuts against the back wall. The spring 1000 is a compression spring designed to provide an appropriate level of bias against the flexible interconnection member 236 after installation. The flexible interconnection member 236 is then inserted so that spring 1000 slides over the spring holding post 802, and pushed further until the button 112 is flush with the edge of the tray portion 100. The guide tab is inserted into an opening 1002 at the rear of the housing 222. At this point, the locking tab 706 snaps upward against the catch 912 to lock the flexible interconnection member 236 in place.

During operation, the connection members 202, 204 may be moved from a closed position to an open position in cooperation of the flexible interconnection member 236. Due to the bias of the spring 1000, it will be appreciated that the connection members 202, 204 are normally maintained in their closed position laterally inward towards the center of the tray portion 100. The connection members 202, 204 can be moved to the open position (toward the edge of the tray) through a variety of advantageous techniques. For example, the button 112 may be depressed by the user to open the connection members 202, 204. During this operation, an inward movement of the button 112 creates a compression force against the spring 1000 and slides the flexible straps 240, 242 within their respective guide slots 224, 226 toward the connection members 202, 204. This, in turn, causes the connection members 202, 204 to slide outward to their open position along the guide extensions 206–212.

Additionally, the connection members 202, 204 may be moved to their open position by the operation of either one of the connection members 202, 204. For example, a user may grasp the hand receiving portion 300 of connection member 202 to slide it outward, causing the flexible strap 240 to slide in its guide slots 224. The rigid portion 238 and button 112 slide inwardly with the housing 222. The inward movement of the rigid portion 238 causes the flexible strap 242 to slide within its guide slot 226, to thereby move the connection member 204 to an open position. Of course, the same operation may be utilized with connection member 204. This advantageously allows for one-handed operation with either connection member of the preferred tray according to the present invention.

It should be understood that an alternate embodiment need not include the button 112 on the flexible interconnection member 236 for proper operation. However, the button 112 is preferred for the user's convenience.

It will be apparent to those skilled in the art that various modifications and variations can be made in the tray of the present invention and in the construction of this tray without departing from the scope or spirit of the invention. Thus, it is intended that the present invention cover the modifications and variations of the invention provided they come within the scope of the appended claims and their equivalents.

What is claimed is:

1. A tray adapted for connection to a juvenile product comprising:

a tray portion;

a first connection member and a second connection member disposed adjacent to a bottom surface of the tray portion for connecting the tray portion to the juvenile product, each connection member being operable between an open and a closed position; and a flexible interconnection member disposed adjacent to the bottom surface of the tray portion and connected to the first and second connection members so that an operation of the first connection member causes a corresponding operation in the second connection member.

2. The tray of claim 1, wherein a top surface of the tray portion includes a flat surface surrounded by a raised edge.

3. The tray of claim 1, wherein the bottom surface of the tray portion includes first and second pairs of guide extensions adapted to receive the first and second connection members, respectively, and to guide the first and second connection members in a sliding action between the open and closed positions.

4. The tray of claim 1, wherein the bottom surface of the tray portion includes a plurality of rails adapted to cooperate with the first and second connection members.

5. The tray of claim 1, wherein the bottom surface of the tray portion includes a stop tab.

6. The tray of claim 1, wherein the bottom surface of the tray portion includes a housing for receiving the flexible interconnection member, said housing including a central portion.

7. The tray of claim 6, wherein the housing comprises a pair of guide slots extending from the bottom surface of the tray.

8. The tray of claim 7, wherein each of the pair of guide slots forms a curve from the central portion to a location on the bottom surface of the tray adjacent to the first and second connection members.

9. The tray of claim 6, wherein each of the pair of guide slots includes an opening on an inner extension and a horizontal extension on an outer extension.

10. The tray of claim 6, wherein the central portion comprises:

an enclosed portion including a surface substantially parallel to the bottom surface of the tray;

a plurality of parallel extensions from the bottom surface of the tray; and a back stop portion.

11. The tray of claim 10, wherein the enclosed portion includes a vertical stop for cooperating with the flexible interconnection member.

12. The tray of claim 10, wherein the back stop portion includes a slot for receiving a portion of the flexible interconnection member.

13. The tray of claim 1, wherein the first connection member comprises:

a hand receiving portion;

a fastening portion for fastening the first connection member to the tray portion; and a connection portion adapted to engage with the juvenile product to connect the tray portion to the juvenile product.

14. The tray of claim 13, wherein the fastening portion comprises a plurality of tab extensions adapted to snap into a receiving orifice in the tray portion.

15. The tray of claim 13, wherein the first connection member further comprises a slot for receiving and interconnecting with the flexible interconnection member.

16. The tray of claim 1, wherein the flexible interconnection member includes a first and a second flexible connection strap for connection to the respective first and second connection members.

17. The tray of claim 16, wherein each of the first and second flexible connection strays is disposed in a pair of guide slots extending from the bottom surface of the tray.

18. The tray of claim 16, wherein each of the first and second flexible connection straps includes a U-shaped connection segment.

19. The tray of claim 16, wherein the flexible interconnection member includes a rigid portion connected to the first and second flexible connection straps.

20. The tray of claim 19, wherein the flexible interconnection member includes a button portion connected to the rigid portion and disposed adjacent to an edge of the tray.

* * * * *

UNITED STATES PATENT AND TRADEMARK OFFICE

CERTIFICATE OF CORRECTION

PATENT NO. : 5,823,615

DATED : October 20, 1998

INVENTOR(S) : Robert E. Haut

It is certified that error appears in the above-indentified patent and that said Letters Patent is hereby corrected as shown below:

Column 8, Line 40, "strays" should read --straps--

Signed and Sealed this

Thirteenth Day of July, 1999

*Attest:*

*Attesting Officer*

Q. TODD DICKINSON

*Acting Commissioner of Patents and Trademarks*